United States Patent [19]

Baldwin et al.

[11] Patent Number: 4,966,179

[45] Date of Patent: Oct. 30, 1990

[54] EMERGENCY UMBRELLA

[75] Inventors: Blair F. Baldwin, New York, N.Y.; W. Barton Baldwin, Newport, R.I.; William C. Lamson, Huntington, Conn.; Harold M. Miller, East Greenwich; John J. Grenga, Greenville, both of R.I.

[73] Assignee: Bexel Corporation, New York, N.Y.

[21] Appl. No.: 327,328

[22] Filed: Mar. 22, 1989

Related U.S. Application Data

[63] Continuation-in-part of Ser. No. 126,207, Nov. 27, 1987, Pat. No. 4,842,003.

[51] Int. Cl.[5] ..... A01G 13/02

[52] U.S. Cl. ..... 135/19.5; 135/33 R

[58] Field of Search ..... 135/18, 19.5, 16, 20, 135/33 C, 33 R, 23, 20 TH

[56] References Cited

U.S. PATENT DOCUMENTS

| | | | |
|---|---|---|---|
| 369,374 | 9/1887 | Vail | 135/25 R |
| 1,349,281 | 8/1920 | King | 135/20 R |
| 1,431,775 | 10/1922 | Cannon | 135/20 R |
| 1,592,723 | 7/1926 | Chism | 135/33 C |
| 1,608,394 | 11/1926 | Henry | 135/23 |
| 2,465,140 | 3/1949 | Vila | 135/19.5 |
| 3,559,661 | 9/1971 | O'Rear | 135/20 R |
| 3,709,238 | 1/1973 | Leopoldi | 135/20 R |
| 4,624,275 | 11/1986 | Baldwin | 135/19.5 |
| 4,794,939 | 1/1989 | Okuda | 135/20 R |

FOREIGN PATENT DOCUMENTS

| | | | |
|---|---|---|---|
| 2111848 | 9/1972 | Fed. Rep. of Germany | 135/25 R |

*Primary Examiner*—Henry E. Raduazo

*Attorney, Agent, or Firm*—Burgess, Ryan & Wayne

[57] ABSTRACT

An umbrella includes a hollow tubular handle, a hub slidably contained in the handle between an upper extended position and a lower stored position; a spider hinge mounted on the hub and including radially extending spider arms; a plurality of flexible struts, each having a fixed end and a free end, with each strut having a width which tapers from the fixed end to the fre end and with the fixed end being secured on each spider arm; a retainer bushing and plug which fixedly secures the spider hinge onto the hub; each strut further having a block thereon with an outwardly radially extending opening; a cord extending peripherally about the umbrella and connected within the openings of the blocks and thereby to the struts for applying a pre-loading tensioning force to the struts so as to bend the struts into a bowed configuration; and a one-piece web of flexible, water-resistant material connected to the ends of the tensioned struts.

22 Claims, 5 Drawing Sheets

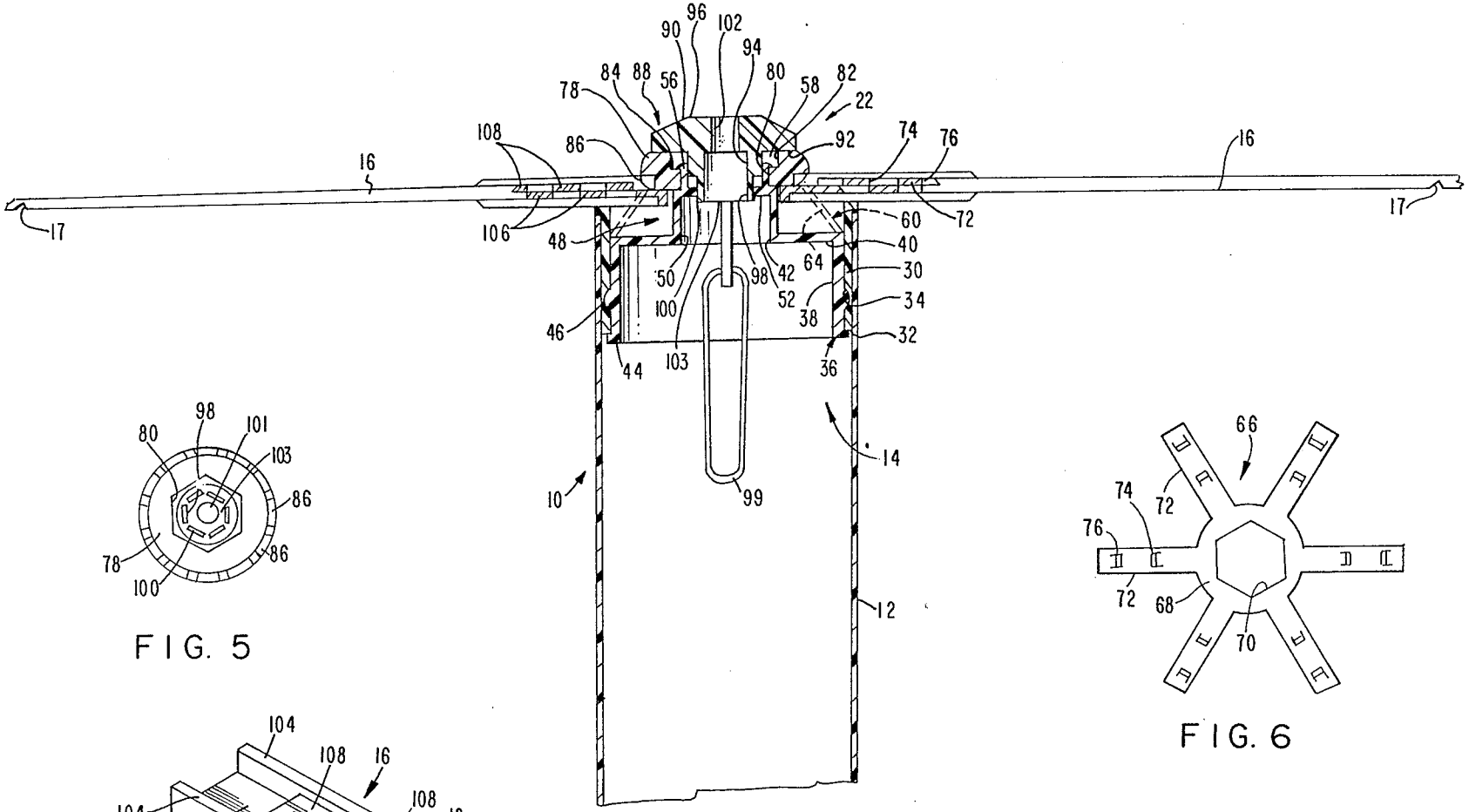
FIG. 3
FIG. 6
FIG. 5
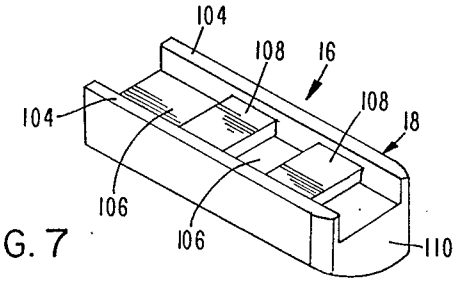
FIG. 7

EMERGENCY UMBRELLA

REFERENCE TO RELATED APPLICATIONS

This application is a continuation in part of the U.S. patent application Ser. No. 126,207, filed Nov. 27, 1987 and now U.S. Pat. No. 4,842,003 to Blair F. Baldwin and et al and entitled Emergency Umbrella, and having a common assignee herewith.

BACKGROUND OF THE INVENTION

This invention relates generally to umbrella and more particularly is detected to an emergency umbrella in which the handle also functions as a carrying case.

Because of unpredictability in the weather, it would be desirable to always have an umbrella ready at hand in case of an emergency. However, the size and bulkiness of conventional umbrellas does not make this feasible. Although there are presently on the market conventional umbrellas sold, for example, under the trademark "Totes" which are compact and fit within a briefcase, such umbrellas are rather complex in construction, use costly raw materials and are therefore, expensive and relatively heavy.

Further, with such conventional umbrellas, the canopy thereof is formed by substantially triangular sections, usually four or more, connected together along seams. The side edges of the substantially triangular sections are curved outwardly when unattached to other triangular sections to provide convex edges. When the canopy formed of such sections is operatively employed with an umbrella, the reinforcement struts which are attached between the center of the main struts and the handle, push against the seams, and in particular, midway along the connected sided edges of the panels, in order to impact a desired bowed effect to the canopy. In this manner, because of the shape of the panels, the umbrella is permitted to go into its open bowed state. Therefore, the maximum tensile strength is at the midpoint of the main struts. Since the main struts are weaker toward their ends, this is advantageous.

Disposable umbrellas of the type in which the handle also functions as a carrying case are disclosed, for example, in U.S. Pat. No. 4,624,275 to the same inventor herein. However, with this disposable umbrella, the canopy and struts must be physically removed through one end of the tubular handle and then attached at the opposite end thereof. This may be rather inconvenient and troublesome.

U.S. Pat. No. 2,700,390 discloses a disposable umbrella in which the handle is detachable from the main portion of the umbrella and serves as a carrying case therefor. With this umbrella, the struts or ribs are normally pivoted in a direction opposite that from a normally closing umbrella, that is, in a direction inverted from a conventional umbrella. In order to prevent the struts from inverting during normal use, it is necessary with such an umbrella to utilize cords or similar type elements to tie down the struts. Further, when the umbrella is contained within the handle, the struts and canopy are inverted first and then inserted into the handle, with the hub being used as a cap on top of the open end of the handle. In operation, the entire canopy, struts and cap must first be removed from the handle, then inverted so that the cap is used as a plug on top of the handle. The canopy and struts must then be pushed down to their operable position, with the struts then being tied down by cords to the handle. This umbrella is, therefore, relatively complicated and difficult to use.

U.S. Pat. No. 3,186,421 discloses a compact umbrella in which an insert block is slidably movable within a handle between a first stored position and a second open position, with struts pivotally connected to the insert block. When the insert block is moved to the open position, the struts are opened by gravity and position themselves within respective receiving slots in the handle. It is the receiving slots that maintain the struts in their open position.

U.S. Pat. No. 4,084,600 discloses an umbrella in which the struts or ribs are pivotally secured to a hub which slides within the handle. In this patent, the struts or ribs are pivotally attached to the hub for movement to a completely inverted position when it is carried within the handle. However, a relatively complicated arrangement of a biased locking plate which biases the inner ends of the struts to maintain them in their open position is provided.

U.S. Pat. No. 2,439,752 also discloses an umbrella in which the struts and canopy are insertable within a handle. The struts and canopy are locked in place at the upper end of the handle by a coupling or fastening pin which passes through openings an opposite sides of the upper part of the tubular handle. However, to close the umbrella, the ribs are not pivotable downwardly into the handle, but only laterally in the plane of the umbrella in its open position and then removed from the handle and inserted therein for storage.

U.S. Pat. No. 4,456,023 discloses an umbrella which is storable within its carrying handle. However, there is no disclosure as to how the umbrella is opened and from the disclosure in the patent, it appears that such an umbrella has a relatively complicated linkage assembly similar to that of compact umbrellas sold under the trademark "Totes". Sec also U.S. Pat. No. 892,813.

U.S. Pat. No. 2,747,592 discloses a collapsible umbrella which is also relatively complicated in construction and use.

French Patent No. 1,429,394 dislcoses an umbrella having a ball which is slidable within a handle between the upper and lower positions. A canopy is secured by angled cords to the ball and is normally held with the ball in the handle. In use, when the ball is pulled out by an auxiliary cord, the canopy is forced out of the handle and is held in its open position by the angled cords secured to the central ball. In effect, the French patent is similar to the aforementioned U.S. PAt. No. 2,700,390 which requires cords to tie down the struts or canopy to prevent the umbrella from inverting. Although U.S. Pat. No. 2,994,333 discloses a peripheral cord, this cord is used for securing the canopy, and separate tie down cords are required for imparting a bow shape to the umbrella.

U.S. Pat. No. 3,709,238 discloses an umbrella in which the hub which contains the umbrella struts connected thereto is slidable within the handle. During folding of the umbrella, the hub slides inwardly into the handle and the struts and canopy fold upwardly and follow the hub into the handle. An inwardly extending annular shoulder is provided for preventing escape of the hub from the handle. Radially extending flexible stays or struts support the canopy material in the extended open position. However, to maintain the canopy in its open position, extending cord members are connected between the struts and the hub and are, therefore, similar to the aforementioned U.S. Pat. No. 2,700,390 and French Patent No. 1,429,394.

U.S. Pat. No. 3,177,883 discloses an umbrella which is relevant for its disclosure of living hinges to connect the struts to the hub. However, the struts and hubs are not storable within the handle.

U.S. Pat. No. 4,627,455 discloses an umbrella rib linkage system which is relatively complicated. However, this patent is relevant for its disclosure in that the ribs have rounded tips.

The following patents are less relevant than the above U.S. Pat. Nos.: 1,345,067; 1,457,679; 1,484,367; 1,547,538; 1,697,520; 1,858,960; 2,044,805; 2,051,750; 2,091,676; 3,765,433; and UK Pat. No. 9,087.

U.S. Pat. No. 284,495 discloses an umbrella having a canopy provided with a cord enclosed in the canopy seams, and a strut or rib structure incorporating a slit tubular recess into which the cord is fit to lock the canopy in place. Such recessed strut is inherently of unifor cross section, determined by the size and shape of the cord.

U.S. Pat. No. 369,374 discloses a cane umbrella. As described therein, struts are tapered so that the peripheral end will have considerably more flexibility and the struts or ribs can be solid cross-section or hollow on the underside. The struts or ribs are hingedly connected to a central hub which is locked down on top of the handle by a screw-threaded center piece. However, to store the umbrella, the center piece must be unscrewed and the hub removed, whereupon the struts are pivoted to a closed position and then inserted through the handle, followed by closure of the center piece on top of the handle. This renders the construction relatively complicated in use.

U.S. Pat. No. 3,844,301 discloses a collapsible umbrella in which the struts are fixedly held to a hub which is slidable within the handle of the umbrella. With this construction, guide tracks must be employed in the handle to deploy the struts in an arcuate configuration as they exit the handle. Because of the guide tracks that must be employed within the handle, the upper end of the handle must be made in an enlarged configuration and the molding thereof becomes relatively complicated and expensive. Without the guide tracks in the handle, there would be no initial bending of the struts as they exit the handle. In addition, this patent discloses struts of a uniform cross section. In this regard, because of such uniform cross section, the struts must have a uniform bending throughout the length thereof. More importantly, it is necessary to use struts of a uniform cross-section in view of the use of guide tracks in the handle. If the struts were of varying a cross section, the guide tracks would be inoperative or at least would function improperly. Still further, with this arrangement, after the struts extend partially from the handle with a slight bending thereto, the canopy begins to expand and applies a force to the ends of the struts. When the canopy is stretched to a certain extent, it causes a buckling of the struts which forces them into a downwardly bowed configuration. Thus, it is the canopy which causes the struts to conform to the desired shape of the canopy.

OBJECTS AND SUMMARY OF THE INVENTION

Accordingly, it is an object of the present invention to provide a disposable, reusable umbrellat that overcomes the aforementioned problems with the prior art.

It is another object of the present invention to provide an umbrella having tapered struts and a cord extending peripherally around the umbrella and secured to the free end of the struts for imparting a tensioning force to force the umbrellas into a downwardly bowed shape.

It is still another oject of the present invention to provide an umbrella in which the aforementioned struts are channelled or cored.

It is yet another object of the present invention to provide an umbrella in which the length of the cord is adjustable to vary the tension at the free end of the struts and thereby change the extent of the bowed configuration, and in addition, imparting upwind, downwind, vertical and horizontal rigidity.

It is a further object of the present invention to provide an umbrella in which each strut is substantially a cantilevered beam supported at the central hub and connected to the canopy only at the canopy periphery, with each strut engaged within retaining pockets formed in the canopy.

It is a still further object of the present invention to provide an umbrella in which the struts are rigidly connected to the hub and are sufficiently flexible to bend between an upright position for storage and a downwardly bowed operational portion.

It is a yet further object of the present invention in which the struts and canopy are prevented from rotational movement.

It is another object of the present invention to provide an umbrella in which the canopy can be made of a single piece of web material.

It is still another object of the present invention to provide an umbrella that is relatively lightweight, easy and economical to manufacture and use, due to the simplified construction and the reduction and simplification of parts.

It is yet another object of the present invention to provide an umbrella having a one piece canopy, and which is not formed by a plurality of curved triangular sections secured together by seams.

It is a further object of the present invention to provide an umbrella in which tension is provided on the struts immediately adjacent to the hub and at the outer free ends to permit bending, and not at the mid-sections of the struts, and because of the channelling and taper of the struts, the umbrella bends substantially only at the free ends.

It is a still further object of the present invention to provide an umbrella which opens and closes with an upward or downward thrusting motion, thus using air pressure to open and close the umbrella.

In accordance with an aspect of the present invention, an umbrella includes a hollow tubular handle; a hub slidably contained in the handle between an upper extended position and a lower stored position; a plurality of flexibe struts, each having a fixed end and free end, each strut having first dimensions at the fixed end and second dimensions at the free end which are less than the first dimensions; locking means for securing the fixed ends of the struts to the hub; cord means extending peripherally about the umbrella and connected to the struts for applying a tensioning force to the outer ends of the struts so as to bend the struts; cord attaching means on the free end of each strut for securing the cord means thereto; and a web of flexible, water-resistant material connected to the tensioned struts.

The above and other objects, features and advantages of the present invention will become readily apparent from the following detailed description thereof which is to be read in connection with the accompanying drawings.

BRIEF DESCRIPTION OF THE DRAWINGS

FIG. 3 is an enlarged longitudinal cross-sectional view of the umbrella of FIG. 1 in an open position;

FIG. 5 is a bottom plan view of the top plug and retainer bushing of the umbrella of FIG. 1;

FIG. 6 is a top plan view of the spider hinge of the umbrella of FIG. 1;

FIG. 7 is a perspective view of the connected end of a strut;

DETAILED DESCRIPTION OF THE PREFERRED EMBODIMENTS

Figure 1:
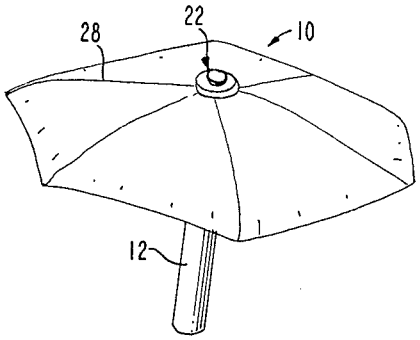
FIG. 1 is a perspective view of an umbrella according to one embodiment of the present invention.
Figure 1A:
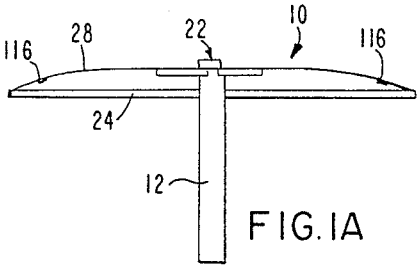
FIG. 1A is a schematic longitudinal cross-section view of the umbrella of FIG. 1 in a slightly tensioned configuration.
Figure 1B:
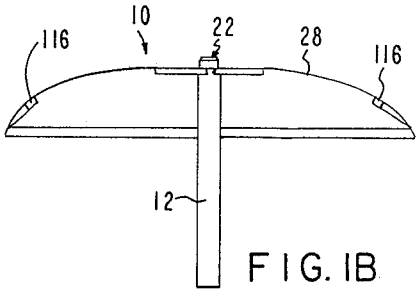
FIG. 1B is a schematic longitudinal cross-sectional view of the umbrella of FIG. 1 in a fully tensioned, operative configuration.
Figure 2:
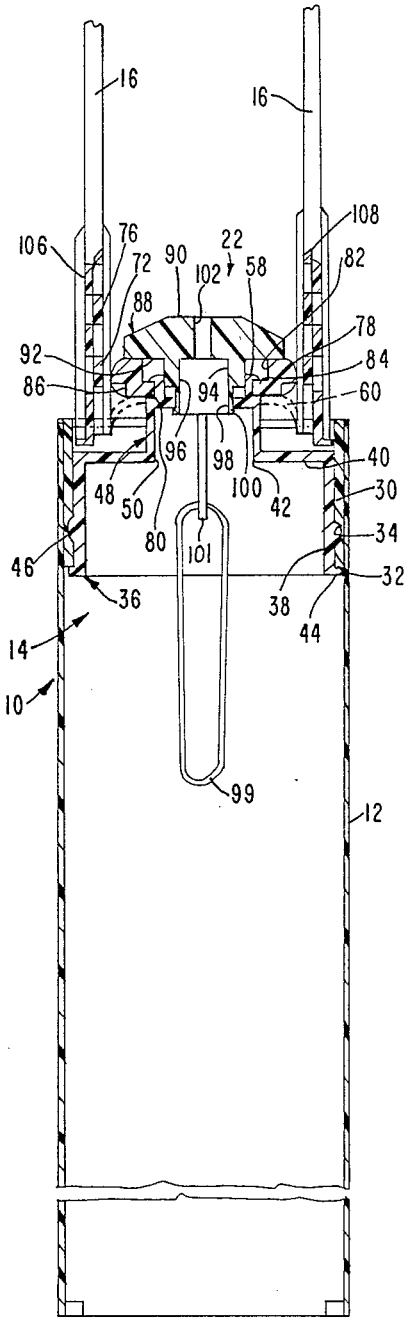
FIG. 2 is an enlarged longitudinal cross-sectional view of the umbrella of FIG. 1 in an intermediate position between the closed and opened positions.
Figure 10:
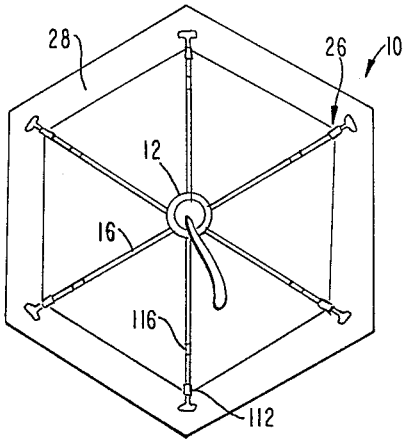
FIG. 10 is a bottom plan view of the umbrella of FIG. 1.

Referring to the drawings in detail, an umbrella 10 according to the present invention generally includes a hollow tubular handle 12, a hub 14 slidable within handle 12 between an upper extended position shown in FIGS. 2 and 3, and a lower stored position (not shown) at the lower end of handle 12, a plurality of flexible struts 16, each strut 16 having a fixed end 18 (FIG. 7) and a free end 20 (FIG. 8), each strut 16 having dimensions at free end 20 which are less than the dimensions at fixed end 18. Umbrella 10 further includes a locking means 22 for securing the fixed ends 18 of struts 16 to hub 14, a cord 24 (FIGS. 8–10) connected to the struts and which extends peripherally about umbrella 10 for applying a tensioning force to struts 16 so as to bend the struts in the manner shown in FIGS. 1A and 1B, cord attaching means 26 on the free end of each strut 16 for securing cord 24 thereto; and a web or canopy 28 of flexible, water-resistant material connected to the tensioned struts 16. Although canopy 22 is shown in a hexagonal configuration, the present invention is not limited to this configuration. Further, canopy 28 is of a one-piece nature, as shown in FIGS. 1 and 10, although it could also be a multi-piece convex paneled canopy.

As shown in FIG. 3, a locking sleeve 30 is secured at the upper end of handle 12, thereby defining a limiting shoulder 32 at the lower end surface thereof. Locking sleeve 30 also includes an inner circumferential groove 34 near the lower end thereof.

Hub 14 includes an inverted cup-like section 36 having a thin annular side wall 38 partially closed by an inwardly extending, upper annular wall 40. Specifically, upper annular wall 40 is formed with a central bore 42 therein. An outwardly directed radial flange 44 is formed at the lower edge of annular wall 38 and cooperates with limiting shoulder 32 of locking sleeve 30 to prevent escape of primary cup-like section 36 of hub 14 from the upper end of handle 12. In addition, an annular detent 46 is formed on the outer surface of annular side wall 38 so as to mate with inner circumferential groove 34 of locking sleeve 30 when radial flange 44 abuts against limiting shoulder 32. Accordingly, as shown in FIG. 3, hub 14 can be releasably locked in the upper open position of the umbrella.

Figure 4:
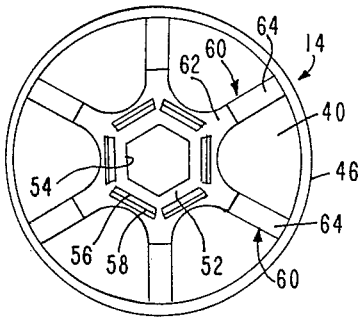
FIG. 4 is a top plan view of the locking hub of the umbrella of FIG. 1.
Figure 12:
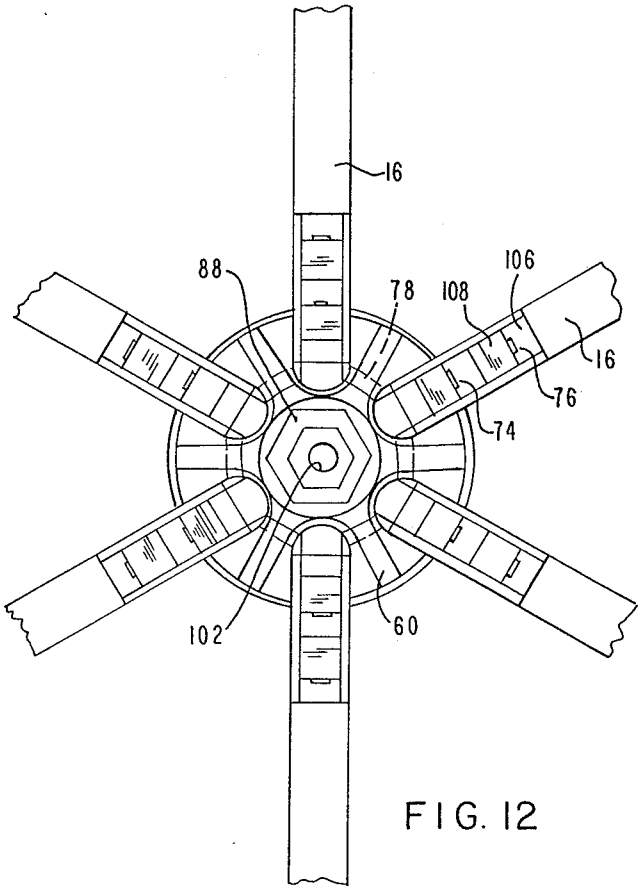
FIG. 12 is a top plan view of the umbrella of FIG. 3.

Hub 14 further includes a secondary cup-like section 48 extending upwardly from upper annular wall 40 of primary cup-like section 36. Specifically, secondary cup-like section 48 includes a thin annular side wall 50 secured to upper annular wall 40 in immediate surrounding relation to center bore 42 and inwardly extending upper annular wall 52 having a central hexagonal bore 54 therein. A plurality of fingers 56 extend upwardly from upper annular wall 52 and specifically, there are six fingers 56, arranged immediately outside of a respective side of bore 54. Each finger 56 includes an annular out-turned tab 58 at the upper free end thereof, the purpose of which will be made apparent from the description which follows. In addition, hub 14 inludes guiding members 60 extending from the upper end of thin annular side wall 50 to the periphery of upper annular wall 40. Specifically, each guiding member 60 includes a horizontal section 62 which is substantially parallel to upper annular walls 40 and 52 and which is secured to the upper end of annular side wall 50, and an angled section 64 which extends from the free end of horizontal section 62 and is connected to the outer periphery of upper annular wall 40. Guiding members 60 are formed as narrow strips at positions. corresponding to the spaces between fingers 56, as shown in FIGS. 4 and 12.

In order to lock struts 16 to hub 14, locking means 22 includes a spider hinge 66 which sits upon upper annular wall 52 in surrounding relation to fingers 56. Specifically, spider hinge 66 is formed as a thin plate, for example, 0.015 inch, with a central section 68 having a hexagonal central bore 70, as shown in FIG. 6, so that central section 68 sits on upper annular wall 52 about fingers 56. Because fingers 56 are arranged in a hexagonal configuration in conformance with the sides of hexagonal central bore 54, spider hinge 66 is non-rotatably mounted on upper annular wall 52. A plurality of spider arms 72 extend radially outwardly from central section 68, the longitudinal axis of each spider arm 72 passing through the center of one side of hexagonal central bore 70 such that there are six spider arms 72 equiangularly spaced about central section 68. Each spider arm 72 includes a downwardly and outwardly punched tab 74 and an upwardly and inwardly punched tab 76, with tab 76 being positioned radially outwardly from tab 74, as shown in FIGS. 3 and 6.

Locking means 22 further includes means for locking spider hinge 66 to hub 14, that is, to prevent vertical movement of spider hinge 66 along fingers 56. Specifically, a retainer bushig 78 having outer rounded corners is provided and provides a reaction surface to take up thrust forces resulting from backwind loading. Retainer bushing 78 includes a first central lower bore 80 and a second central and larger upper bore 82 contiguous therewith and which defined an angular shoulder 84 therebetween. Lower bore 80 has a hexagonal configuration with dimensions substantially identical to the outer dimensions of fingers 56 so as to non-rotatably fit around fingers 56. In addition, central lower bore 80 has a height substantially equal to that of fingers 56. Accordingly, when retainer bushing 78 is fitted around fingers 56, it rests on top of spider hinge 66 such that annular shoulder 84 is engaged by out-turned tabs 58 so as to lock retainer bushing 78 onto hub 14. This, in turn, locks spider hinge 66 also to hub 14. In addition, the lower peripheral, annular corner of retainer bushing 78 is provided with a plurality of recesses 86 for strut engagement, as will be made apparent from the description which follows.

In order to positively lock retainer bushing 78 onto hub 14, a top plug 88 is provided. Top plug 88 includes an englarged head 90 having a planar undersurface 92 which sits on the upper surface of retainer bushing 78. Six fingers 94 extend downwardly from the undersurface 92 of enlarged head 90. Fingers 94 are arranged in a hexagonal arrangement centrally along undersurface 92, each finger including an upper thick section 96 and a lower thin section 98 formed at the free end of upper thick section 96. An outwardly turned tab 100 is formed at the free end of each lower thin section 98. Thus, fingers 94 of top plug 88 can be inserted through central lower and upper bores 80 and 82 of retainer bushing 78 within the area defined by fingers 56 such that upper thick sections 96 bias fingers 56 outwardly into engagement with retainer busing 78. In addition, when top plug 88 is so inserted, under surface 92 of enlarged head 90 thereof fits on the upper surface of retainer bushing 78. Further, lower thin sections 98 of fingers 94 extend through hexagonal central bore 54 such that tabs 100 thereof engage the undersurface of upper annular wall 52 so as to bias enlarged head 90 downwardly into engagement with retainer bushing 78. With this arrangement, spider hinge 66 is tightly held between upper annular wall 52 and retainer bushing 78. As will be appreciated from the discussion which follows, and as shown in FIG. 2, spider arms 72 are made of a material having a resilient nature so that they can bend about the lower annular curved corner of retainer bushing 78 in order that the struts can be moved to the vertical position shown in FIG. 2. In addition, it is noted that enlarged head 90 is formed with a central opening 102. In this manner, the inside of tubular handle 12 is fluidly connected with the outside of umbrella 10 so that any water which becomes trapped within umbrella 10 when the later is in its stored position, can be drained.

Further, a wrist lanyard 99 is connected to sections 98 of fingers 94 as shown in FIG. 2, by connecting elements 101 and 103, and can be placed around the wrist of a user when the umbrella is in its stored configuration, for carrying the umbrella.

Figure 11:
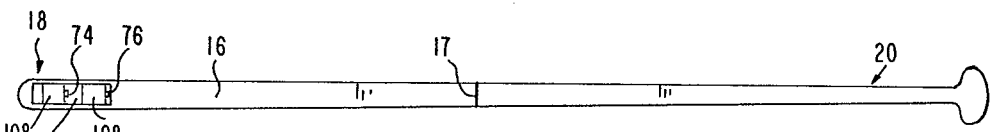
FIG. 11 is a top plan view of a strut according to the present invention.
Figure 8:
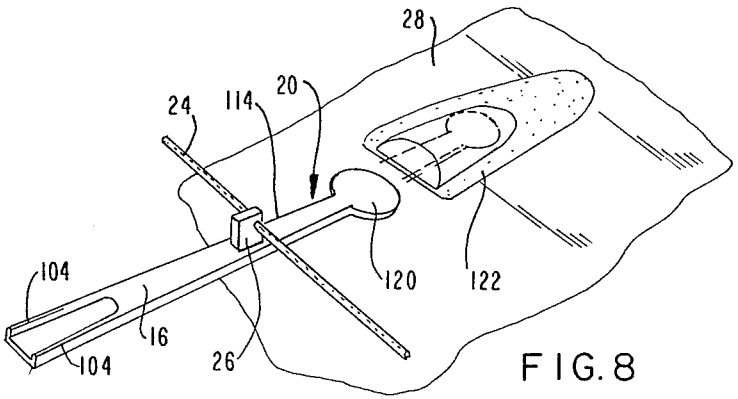
FIG. 8 is a bottom perspective view of a strut disengaged from the canopy.

In accordance with the present invention, six struts 16 are provided, each secured to a spider arm 72. However, any number of struts greater than three can be used. Each strut 16, as shown in FIGS. 8 and 11, has a width which tapers from fixed end 18 to free end 20. In addition, as shown in FIG. 8, each strut 16 has edge walls 104 secured to the side edges of each strut 16, each edge wall 104 having a height which decreases from fixed end 18 toward free end 20, in order to provide a channeled configuration for each strut, that is, to provide a channel or continuously varying width and depth. In this manner, the moment of inertia of each strut is less at the free end 20 thereof. In this regard, because of the decreasing height of edge walls 104 and the decreasing width of each strut 16, free end 20 of each strut 16 will flex or bend to a greater extent than the more rigid fixed end 18. As a result, umbrella 10 will assume the configuration shown in FIG. 1A or FIG. 1B when a pulling force is applied to the free ends of struts 16, as will be described hereinafter. It will be appreciated that the struts can have any other shape, as long as the dimensions at free end 20 are tapered from fixed end 18.

With respect to fixed end 18, edge walls 104 are at their greatest height. At fixed end 18, a first set of connecting plates 106 are provided between edge walls 104 and are spaced from each other in the lengthwise direction of the strut 16 and in the same plane. In like manner, a second set of connecting plates 108 are secured between edge walls 104 and are likewise spaced from each other in the lengthwise direction of the struts 16 and are provided in a second plane which is vertically offset from the first plane of connecting plates 106. In addition, connection plates 106 and 108 are provided in an alternating manner in the lengthwise direction of the struts 16, that is, by providing a connecting plate 108, a connecting plate 106, a connecting plate 108 and a connecting plate 106, and so on. The vertical space between connecting plates 106 and 108 is small and corresponds to the plate-like dimensions of spider hinge 66. In this manner, the fixed end 18 of each strut 16 can be inserted over a spider arm 72, as shown in FIG. 3. As fixed end 18 rides over a spider arm 72, each connecting plate 106 will force the tab 76 down and after each connecting plate 106 passes the tab 76 down and after each connecting plate 106 passes tab 76, tab 76 will again pop up due to the spring-like resilient nature thereof. The end surface 110 of fixed end 18 fits within a recess 86 of retainer bushing 78 so as to limit radial movement of each struct on a respective spider arm 72. At this limiting position, tab 74 is locked against a connecting plate 108, while tab 76 is locked in the opposite direction against a connecting plate 106, as shown in FIG. 3, to lock the strut 16 onto the spider arm 72.

In order to obtain the aforementioned tensioning of umbrella 10 to the configuration shown in FIG. 1A, cord attaching means 26 is provided on the undersurface of each strut 16 at free end 20 thereof. Specifically, each cord attaching means 26 includes a U-shaped block 112, as shown in FIG. 8, with the opening 114 of block 112 facing radially outward. Thus, cord 24 can be inserted within opening 114 of each block 112 and will be held in place and will not pop out of blocks 112, as long as there is some tensioning force. Preferably, cord 24 has a length which is less than the imaginary line connecting blocks 112 when struts 16 are in an unbiased, outwardly extending position. In this manner, cord 24 normally bends struts 16 so that umbrella 10 will assume the configuration shown in FIG. 1A. Alternatively, cord 24 can be a continuous elastic band or the like which is stretched about blocks 112, so as to permit the band to be stretched when the struts go through the neutral (horizontal) position and then will pull and hold the struts in the locked position until an excessive external force will force the struts back through the neutral position into the unlocked closing state.

Figure 9:
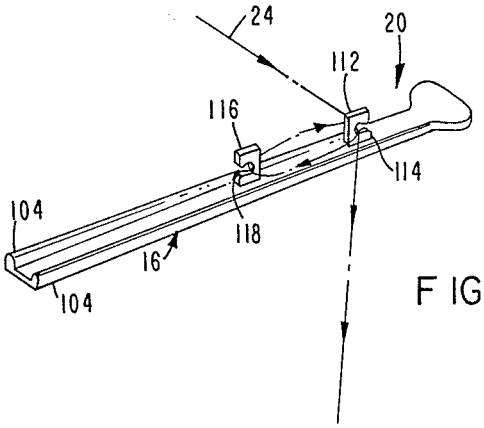
FIG. 9 is a bottom perspective view of a strut according to another embodiment of the present invention.

In order to obtain a greater bowed configuration of umbrella 10 for operation thereof, an additional U-shaped block 116 can be provided on the same surface of each strut 16, but radially inwardly from block 112 and with the opening 118 thereof facing radially inwardly. Thus, as shown in FIG. 9, cord 24 can be wrapped about blocks 112 and 116 to shorten the peripheral length thereof and thereby provide a greater bowing force to umbrella 10, thereby placing the struts in their maximum pre-loaded state, as shown in FIG. 1B.

Figure 13A:
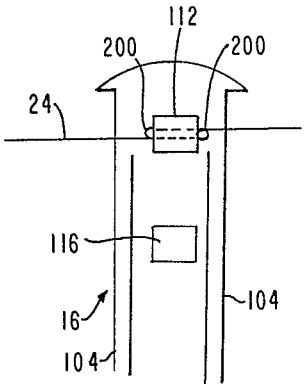
FIG. 13A is a top plan view of a strut in the untensioned state of FIG. 1A and with a non-endless cord having balls on opposite ends thereof.
Figure 13B:
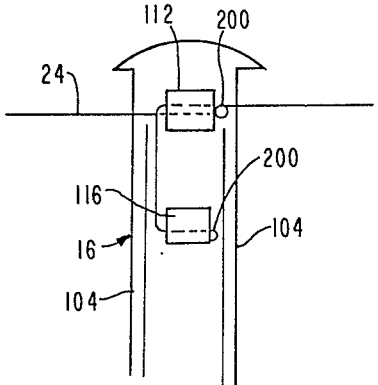
FIG. 13B is a top plan view of the strut of FIG. 13A in the tensioned state of FIG. 1B.

Of course, it will be understood that cord 24 need not be endless. For example, a ball 200 can be secured to each end of cord 24, so as to restrain the end in a block 112 or block 116, as shown in FIGS. 13A and 13B. FIG. 13A shows the struts 16 in an untensioned state and FIG. 13B shows the strut 16 in a tensioned state. Of course, a slight bow is imparted in the tensioned state.

As shown, in FIG. 8, free end 20 of each strut 16 includes an enlarged circular section 120. The underside of canopy 28 includes elongated pockets 122 formed at the outer periphery and at the underside of canopy 28 for receiving circular sections 120 of struts 16. Pockets 122 can be adhered to the underside of canopy 28 by any suitable means, such as an adhesive, pressure sensitive tape, stitching or the like. Pockets 122 can have elasticity. Thus, canopy 28 is held on the free ends of struts 16. However, the canopy is not tensioned and does not provide a tensioning force to the struts as in the prior art.

Accordingly, in order to change umbrella 10 from its open configuration shown in FIG. 3 to its stored configuration within tubular handle 12, the bow of struts 16 is inverted from the position shown in FIG. 1A and moved to the position shown in FIG. 2. In such position, spider arms 72 will wrap about retainer bushing 78, that is, will be folded about a 90° arc, and struts 16 will be vertically oriented. Then, hub 14 is pushed vertically downward into tubular handle 12 which also receives struts 16. In order to open umbrella 10, the reverse procedure is followed.

If it is difficult to provide an inverse bowing force to struts 16 during closing of the umbrella, the configuration shown in FIG. 9 can be used. In such case, in the stored configuration, cord 24 would be fixed only within U-shaped blocks 112. In such position, only a slight, or no, bowing force would be provided on struts 16. Then, when struts 16 are moved from the stored position to that shown in FIG. 3, cord 24 could be tightened about U-shaped block 116 to thereby provide an additional bowing force to strut 16 so that umbrella 10 attains the configuration shown in FIG. 1B.

Figure 1C:
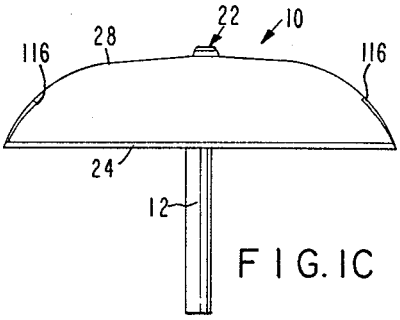
FIG. 1C is a schematic longitudinal cross-sectional view of the umbrella of FIG. 1 in a fully tensioned configuration with the struts of FIG. 9A.
Figure 9A:
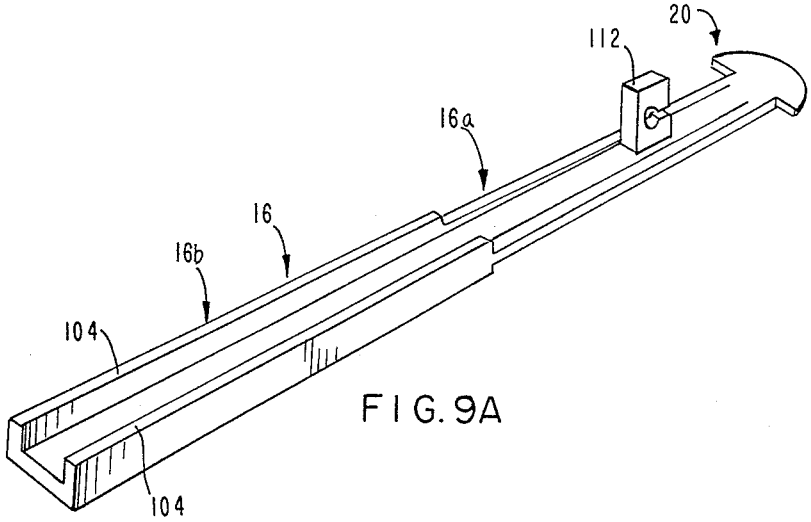
FIG. 9A is a top perspective view of a strut according to still another embodiment of the present invention.
Figure 9B:
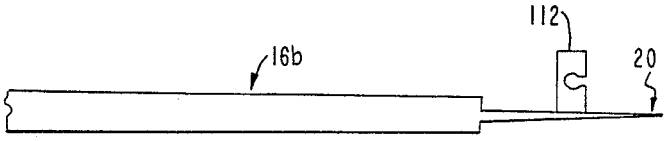
FIG. 9B is a side elevational view of the strut of FIG. 9A.
Figure 9C:
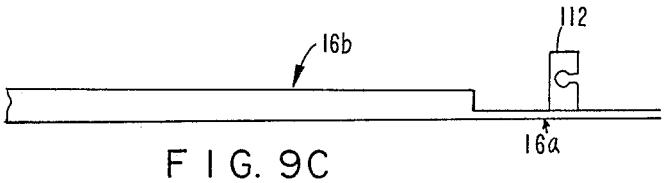
FIG. 9C is a side elevational view of a strut according to yet another, embodiment of the present invention.

As an alternative embodiment, as shown in FIGS. 9A and 9B, the cross-section of the strut 16 can change in a discontinuous manner. For example, the last-fourth length section **16*a* of strut 16 can be made of a much smaller cross-section than the remainder section 16*b* of strut 16. In such case, the channel formed by edge walls 104 between sections 16*a* and 16*b* can be continuous or discontinuous, depending upon the depth of the channel. As a result, strut 16 is more flexible in section 16*a* thereof. Accordingly, it is easy for strut 16 to go through the neutral position when the umbrella is opened and closed by air pressure. Also, when locking the umbrella in its operative configuration, as shown in FIG. 1C, it will be easier to lock because of the greater flexibility in section 16*a*. In such case, as shown in FIG. 1C, the bow of the umbrella will be mostly at the end. Because section 16*b* can therefore be made with a greater cross-sectional area, the strength of the umbrella will withstand comparable or increased wind loads. Of course, it will be appreciated that the discontinuity could be only in the upper wall or lower wall or strut 16, for example, as shown in FIG. 9C**.

Figure 9D:
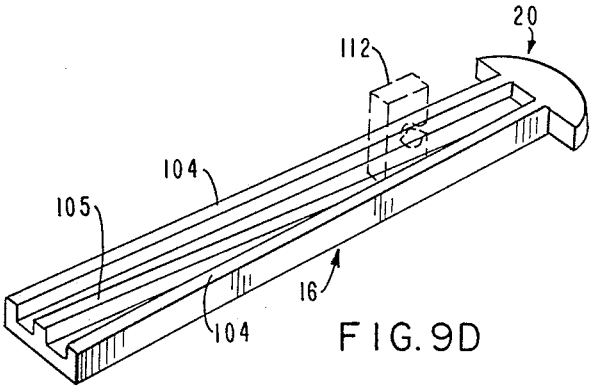
FIG. 9D is a top perspective view of a strut according to a further embodiment of the present invention.

Alternatively, as shown in FIG. 9D, end walls 104 of strut 16 can be constant. In such case, a center longitudinal wall 105 is provided which decreases in height and/or width toward the free end of the strut, and can be of varying length.

It will therefore be appreciated that, with the present invention, the struts 16 are configured so as to provide a greater bowing at the free ends thereof and such that the greatest tensile force occurds at such free ends 20 and fixed ends 18. In addition, the struts 16 are tensioned by an external cord and not by the canopy so that there is no large force by the struts on the canopy, which conventionally results in tearing of the canopy along the convex seams. In other words, the canopy does not provide the bowing force, but rather, this is provided by cord 24, in the configuration of FIGS. 1A and 1B. In such case, the struts as designed by complicated and extensive computer analysis can, for example, withstand upwind and downwind and off-center deflection wind forces of approximately 20 mph. In this regard, it is noted that in Baumeister & Marks, Standard Handbook for Mechanical Engineers, Ed. VIII, Pages 9–12, Table 1, it is stated that the average wind velocity for New York City is 14.6 mph, which is the highest average velocity listed for any city.

In addition, there need not ben any hinge means, whether living or otherwise. This is because struts 16 can move between the position shown in FIG. 2 and FIG. 3 by bending of spider arm 72 about retainer bushing 78, that is, without any hinges. Still further, the struts 16 are locked to hub 14 by the aforementioned arrangement of spider arm 72 and the specific configuration at the fixed end 18 of each strut 16.

Still further, the tensioning force on struts 16 can be applied by the user after the struts 16 are removed from tubular handle 12 so that the user can easily change the bowed direction of struts 16 for change between the stored configuration and the open, operative configuration of umbrella 10 of FIG. 1B.

In addition, each strut 16 maybe provided with a living hinge 17 mid-way therealong to reduce the length of the struts 16 in their stored configuration. In such case, the height of handle 12 can be reduced in size.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined by the appended claims.

What is claimed is:

1. An umbrella comprising:

a hollow tubular handle;

a hub slidably containe in said handle between an upper extended position and a lower stored position;

a plurality of flexible struts, each having a fixed end and a free end, each strut having first dimensions at said fixed end and second dimensions at said free end which are less than said first dimensions;

locking means for rigidly and fixedly securing said fixed end of said strut to said hub in a non-pivotal manner;

cord means extending peripherally about said umbrella and connected to said struts for applying a tensioning force to said strut so as to bend said struts with said struts bending to a greater extent at said free ends;

cord attaching means connected on the free end of each strut for securing said cord means thereto; and a web of flexible, water-resistant material connected to said tensioned struts.

2. An umbrella according to claim 1, wherein said hollow tubular handle includes first locking means at an upper end thereof and said hub includes second locking means for engaging with said first locking means to releasably lock said hub at the upper end of said hollow tubular handle at said upper extended position.

3. An umbrella according to claim 2, wherein said first locking means includes one of a groove and detent at the upper end of said handle and said second locking means includes the other of a groove and detent on said hub for mating therewith.

4. An umbrella according to claim 1, wherein said hub includes an inverted cup-like section slidable within said hollow tubular handle and a strut locking section mounted on said inverted cup-like section.

5. An umbrella according to claim 4, wherein said inverted cup-like section includes an annular detent and said hollow tubular handle includes an inner circumferential groove for engagement with said annular detent for locking the hub in said upper extended position.

6. An umbrella according to claim 1, wherien each said cord attaching means includes a block secured to a free end thereof, each block including an opening for receiving said cord means in a tensioning manner.

7. An umbrella according to claim 1, wherein each strut has a width which tapers from said fixed end to said free end thereof.

8. An umbrella according to claim 1, wherein each strut has side edges extending along the length thereof and edge walls connected with said side edges, each edge wall having a height which tapers from said fixed end to said free end thereof.

9. An umbrella according to claim 1, wherein each said strut is discontinusously tapered from said fixed end to said free end thereof.

10. An umbrella according to claim 1, wherein each said strut has at least one wall extending along the length thereof, and at least one said wall tapers in height from said fixed end to said free end thereof.

11. An umbrella according to claim 10, wherein each strut includes side edges extending along the length thereof and edge walls connected with said side edges, and an additional wall between said edge walls which tapers in height from said fixed end to said free end thereof.

12. An umbrella according to claim 1, wherein said canopy is of a one-piece construction.

13. An umbrella comprising a hollow tubular handle;

a hub slidably contained in said handle between an upper extended position and a lower stored position; said hub including an inverted cup-like section slidable within said hollow tubular handle and a strut locking section mounted on said inverted cuplike section, said strut locking section including a second inverted cup-like section having smaller dimensions than said first cup-like section and mounted centrally to an upper end of said first cup-like section, said second cup-like section including a central opening;

a plurality of flexible struts, each having a fixed end and a free end, each strut having first dimensions at said fixed end and second dimensions at said free end which are less than said first dimensions;

locking means for fixedly securing said fixed ends of said struts to said hub; locking means further including finger means mounted in a circumferential configuration on top of said second cup-like section;

cord means extending peripherally about said umbrella and connected to said struts for applying a tensioning force to said struts so as to bend said struts with said struts bending to a greater extent at said free ends;

cord attaching means on the free end of each strut for securing said cord means thereto; and a web of flexible, water-resistant material connected to said tensioned struts.

14. An umbrella according to claim 13, wherein said second cup-like section includes an upper opening and said finger means includes a plurality of fingers mounted to an upper end of said cup-like section in surrounding relation to said opening, each finger including a locking tab.

15. An umbrella according to claim 14, wherein said locking means includes spider means mounted on said strut locking section of said hub in surrounding relation to said fingers, and retaining means for retaining said spider means on said strut locking section, said spider means including a plurality of radially extending arms for securing said struts thereto.

16. An umbrella according to claim 15, wherein said fingers are arranged in a non-circular configuration and said spider means includes a hub having a central non-circular opening corresponding to the outer circumference of said fingers so as to be non-rotatably mounted thereabout and a plurality of spider arms extending radially outward from said central section, each spider arm being flexible and resilient.

17. An umbrella according to claim 16, wherein said retaining means includes bushing means mounted on said strut locking section for locking said central section of said spider means between said strut locking section and said bushing means and plug means securable with said strut locking section for locking said bushing means and said spider means to said strut locking section.

18. An umbrella according to claim 16, wherein each said spider arm includes first and second locking tabs spaced radially therealong, each locking tab being normally biased away from said spider arm and each locking tab facing in a direction opposite to the other locking tab.

19. An umbrella according to claim 18, wherein the fixed end of each strut has a bayonet type fitting for receiving a spider arm such that said spider arm is locked in said bayonet type fitting by said locking tabs.

20. An umbrella comprising a hollow tubular handle;

a hub slidably contained in said handle between an upper extended position and a lower stored position; said hub including an inverted cup-like section slidable within said hollow tubular handle and a strut locking section mounted on said inverted cup-like section, said strut locking section including a second inverted cup-like section having smaller dimensions than said first cup-like section and mounted centrally to an upper end of said first cup-like section, said second cup-like section including a central opening;

a plurality of flexible struts, each having a fixed end and a free end, each strut having first dimensions at said fixed end and second dimensions at said free end which are less than said first dimensions;

locking means for fixedly securing said fixed ends of said struts to said hub;

cord means extending peripherally about said umbrella and connected to said struts for applying a tensioning force to said struts so as to bend said struts with said struts bending to a greater extent at said free ends;

cord attaching means on the free end of each strut for securing said cord means thereto, each said cord attaching means including a block secured to a free end thereof, each block including an opening for receiving said cord means in a tensioning manner, the opening of each block facing radially outwardly; and a web of flexible, water-resistant material connected to said tensioned struts.

21. An umbrella comprising a hollow tubular handle;

a hub slidably contained in said handle between an upper extended position and a lower stored position;

a plurality of flexible struts, each having a fixed end and a free end, each strut having first dimensions at said fixed end and second dimensions at said free end which are less than said first dimensions; p1 locking means for fixedly securing said fixed ends of said struts to said hub;

cord means extending peripherally about said umbrella and connected to said struts for applying a tensioning force to said struts so as to bend said struts with said struts bending to a greater extent at said free ends;

cord attaching means on the free end of each strut for securing said cord means thereto, a web of flexible, water-resistant material connected to said tensioning struts; and means on at least one said strut for providing tightening of said cord means.

22. An umbrella according to claim 21, wherein said means for providing tightening includes block means on at least one said strut positioned radially inwardly from said cord attaching means and about which said cord means can be wrapped.

* * * * *